US010349718B2

(12) United States Patent
Stewart et al.

(10) Patent No.: US 10,349,718 B2
(45) Date of Patent: Jul. 16, 2019

(54) WATERPROOF HAIR ACCESSORY

(71) Applicants: Jamie K. Stewart, Brighton, MI (US); Andrea Schurig, Milford, MI (US)

(72) Inventors: Jamie K. Stewart, Brighton, MI (US); Andrea Schurig, Milford, MI (US)

( * ) Notice: Subject to any disclaimer, the term of this patent is extended or adjusted under 35 U.S.C. 154(b) by 122 days.

(21) Appl. No.: 15/650,960

(22) Filed: Jul. 16, 2017

(65) Prior Publication Data

US 2019/0014878 A1 Jan. 17, 2019

(51) Int. Cl.

| | |
|---|---|
| ***A45D 7/00*** | (2006.01) |
| ***A45D 8/40*** | (2006.01) |
| ***A45D 19/00*** | (2006.01) |
| ***A45D 20/00*** | (2006.01) |
| ***A45D 8/36*** | (2006.01) |

(52) U.S. Cl.

CPC ..... *A45D 8/40* (2013.01); *A45D 7/00* (2013.01); *A45D 8/36* (2013.01); *A45D 19/00* (2013.01); *A45D 20/00* (2013.01); *A45D 2019/0041* (2013.01)

(58) Field of Classification Search

CPC . A45D 8/40; A45D 8/36; A45D 19/00; A45D 2019/005; A45D 2019/0041; A45D 19/14; A42B 1/12

See application file for complete search history.

(56) References Cited

U.S. PATENT DOCUMENTS 9,380,849 B2 * 7/2016 Domizi ..... A45D 19/18

OTHER PUBLICATIONS

Pantazi ("This hair invention is a game-changer for washing your hair after the gym" Mar. 24, 2017 https://www.thisisinsider.com/roots-only-hair-cap-hair-washing-hack-2017-3 accessed Jan. 15, 2019).*

* cited by examiner

*Primary Examiner* — Kortney L. Klinkel

(57) ABSTRACT

A hair accessory including a liquid impermeable bag comprising a sheet gathered at one end and a band attached to the bag. A method of removing oil from hair including partitioning the hair of the user into a first section and a second section defined by a boundary path on a head of the user which divides the first and the second sections, placing the band along the boundary path, placing the second section inside the bag and washing the first section while keeping the second section dry due to the placing inside the bag. The placement of the band is approximately midway between the front and rear of the head of a user.

18 Claims, 13 Drawing Sheets

WATERPROOF HAIR ACCESSORY

BACKGROUND OF THE INVENTION

1. Field of the Invention

The invention relates to a hair accessory for surrounding a portion of a user's hair.

2. Related Art and Background of the Invention

Oftentimes, an individual desires to wash a portion of his or her hair without having to wash his or her entire head, because drying and styling all of a user's hair takes a large amount of time. This is particularly the case when an individual's hair begins to become oily at the roots particularly above the ears or when an individual's bangs become oily prior to the ends and/or remaining portions of the individual's hair becoming oily.

One solution is to apply a dry shampoo or other oily absorbing material to the hair. However, these products are expensive, make hair dull and feel sticky, and furthermore are not as successful in removing oil as actual washing the oily portions of hair.

As another solution, the individual will part a portion of the hair, e.g., the front portion, restrain the remaining portions, e.g., the rear portions, into a ponytail, and wash the parted, front portion. However, in order to fully wash the front portion including the roots and to effectively rinse all of the shampoo from the hair, the rear portion of the hair must also be wetted, or is accidentally wetted during the washing process. This results in longer drying and styling time.

A more recent solution, is a waterproof sock which only covers a ponytail of a user and is sold under the trademark PonyDry. However, covering only the ponytail of hair of the user results in wetting a total of 6 to 10 inches of the hair adjacent the forehead, and the hair adjacent the neck. Additionally, the hair under the ponytail becomes saturated with water. Furthermore, users have complained that the water enters the sock, and additionally, that layered hair is difficult to entirely insert into the sock.

Thus, there remains a need for a way to successfully remove the oil from one's hair without requiring a long drying and styling time.

SUMMARY OF THE INVENTION

A method of removing oil or residue from a first portion of a user's hair includes placing an elastic band at a location on a head of the user which divides the first portion of the hair to be washed from a second portion of the hair to remain dry; placing a rigid band comprising a liquid impermeable bag partially attached thereto over the elastic band; moving the second portion of the hair to remain dry to an inside of the liquid impermeable bag through a portion of the liquid impermeable bag which is detached from the rigid band; and washing the hair, wherein the first portion of the hair is washed and the second portion of the hair remains dry. Alternatively, the method includes placing a band comprising a liquid impermeable bag partially attached thereto at a location on a head of the user which divides a first portion of the hair to be washed from a second portion of the hair to remain dry. The location on the head is between the front and rear of the head of the user. Due to the location of the band, only the root portion of the very front of the hair can be washed while maintaining the remainder of the hair in a dry state, significantly improving the drying and styling time relative to the prior methods.

The invention solves the problems of the related art by allowing the user to wash only a portion of the user's hair without getting the remaining portions wet, thereby lowering the overall drying and styling time after washing.

BRIEF DESCRIPTION OF THE DRAWINGS

With reference to the detailed description of the invention, the following is a brief description of the drawings, wherein like reference numerals represent like elements.

DETAILED DESCRIPTION OF THE INVENTION

Figure 1:
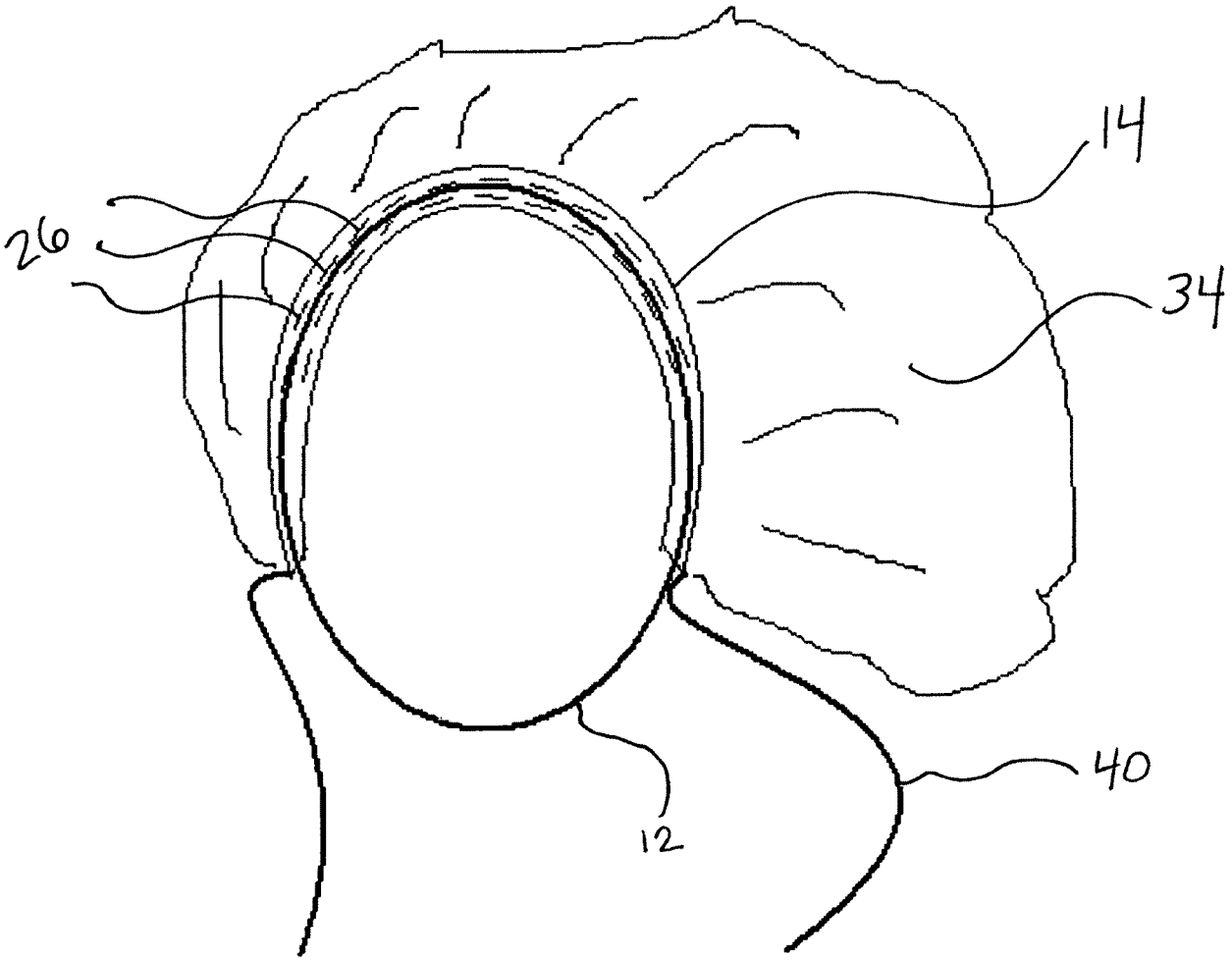
FIG. 1 is a perspective view of an exemplary embodiment of the hair accessory.

The following is a detailed description of the exemplary embodiments, in which like reference numerals refer to like elements. Description of well-known elements is simplified to avoid complicating the description of the present invention. In addition, the drawings proportions may be exaggerated in order to better illustrate the details thereof.

The hair accessory 10 includes: a barrier 12 which divides and restrains a portion of hair (not shown), which aids in providing a waterproof seal between the restrainer portion or hair and the water, and which sits on a user's head (not shown); a rigid band 14 directly attached or sitting on the barrier 12; and a waterproof hair protecting shield 16 which hangs from the rigid band 14.

Figure 2:
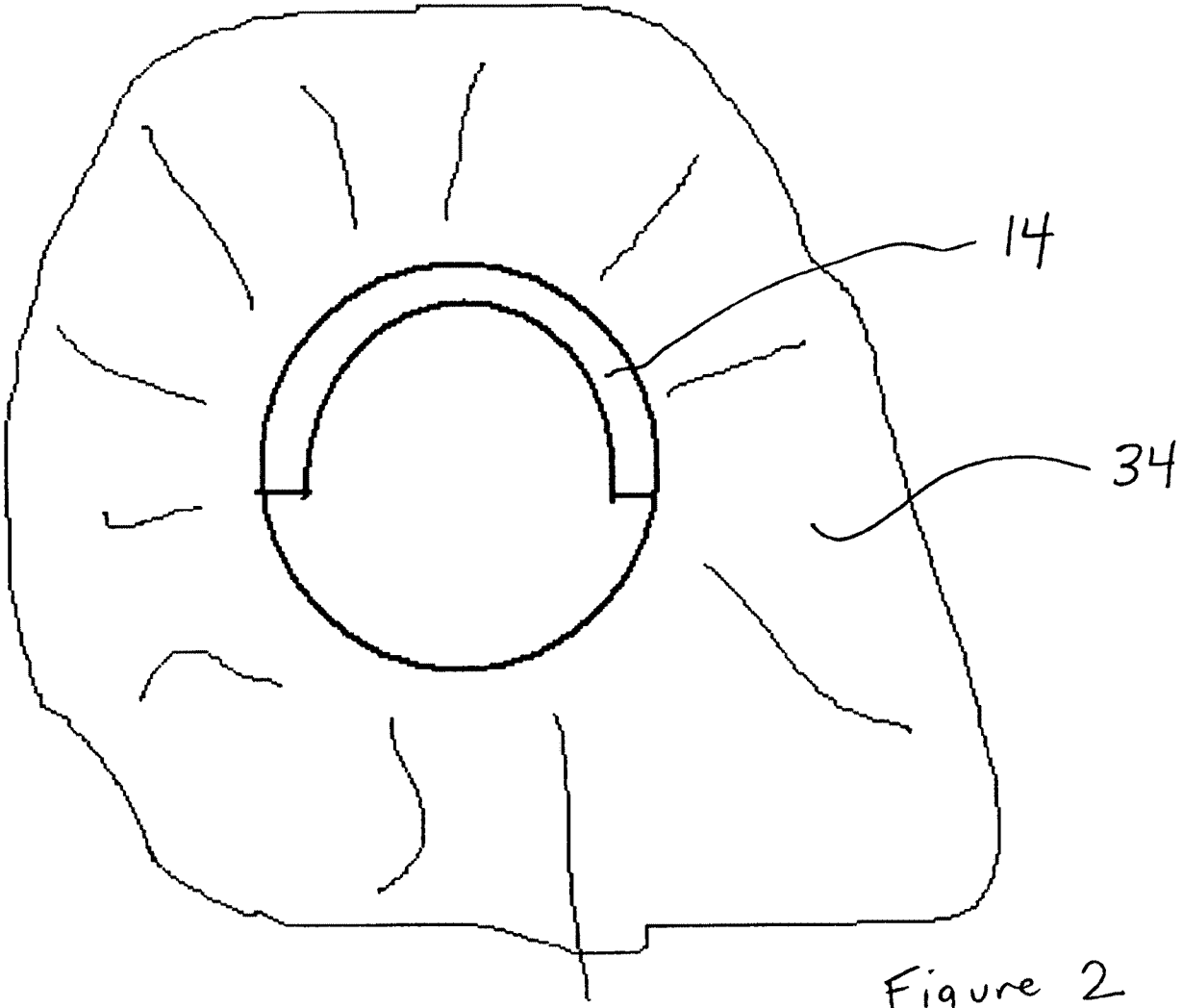
FIG. 2 is a front view of an exemplary embodiment of the rigid band and bag.
Figure 3:
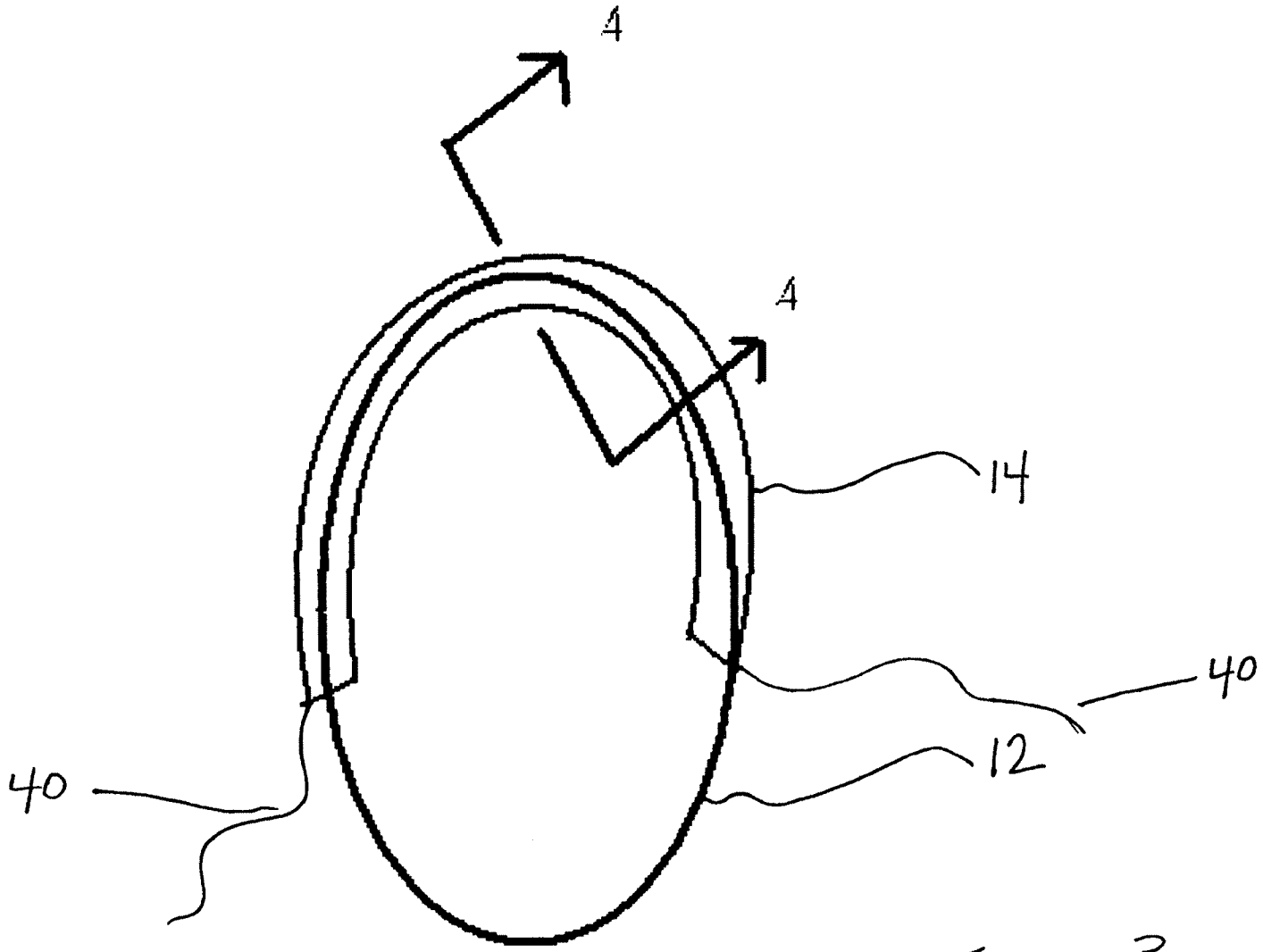
FIG. 3 is a front view of the rigid band and barrier.

In the embodiment shown in FIGS. 1 and 2, the barrier 12 includes an elastic portion which forms a closed loop, such as an elastic band, which is placed around a user's head, slightly behind the user's ears and about 1-3 inches back from the user's forehead hairline. A width of the barrier 12 may be 1-5 cm.

Figure 4A:
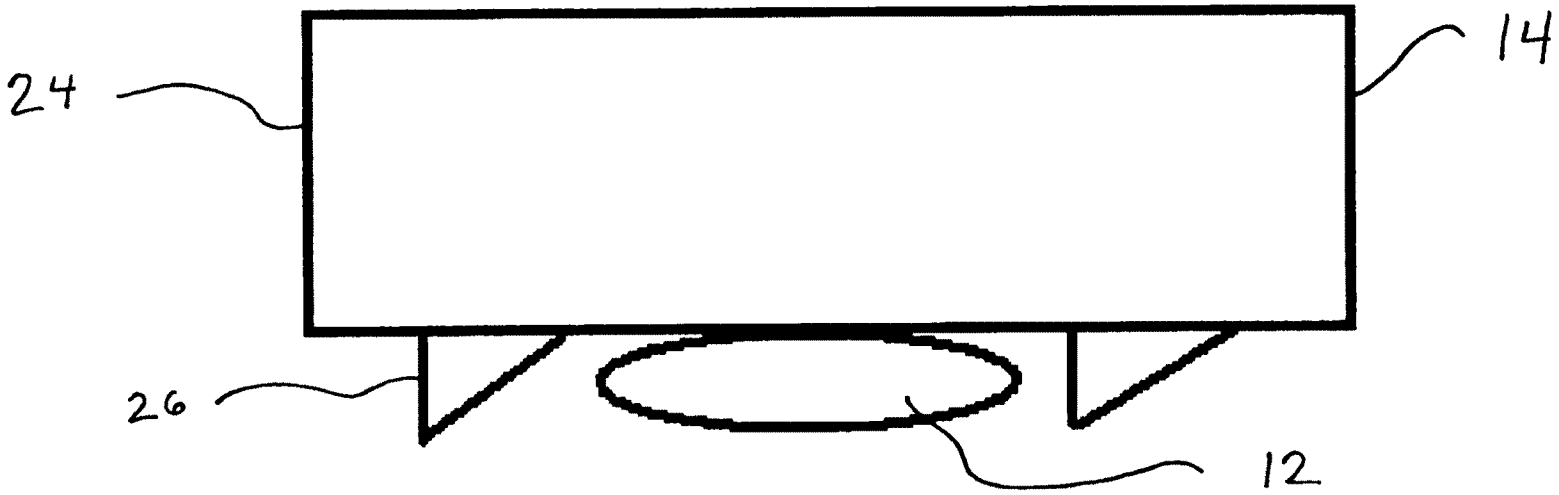
FIG. 4*a* is a cross sectional of one embodiment of the rigid band and barrier.

The rigid band 14 may include a rigid U-shaped portion 24 and a plurality of claw portions 26 extending from the rigid U-shaped portion 24, as shown in FIG. 4*a*. The rigid U-shaped portion 24 and attached claws 26 extends at least halfway around a head of the user, and around more than half of the barrier 12. There may be multiple rows of claws 26 along the rigid portion 24, for example, two rows, and the barrier 12 may be placed between two of the rows of claws 26 to maintain the seal and properly align the rigid portion 24 over the barrier 12.

Figure 4B:
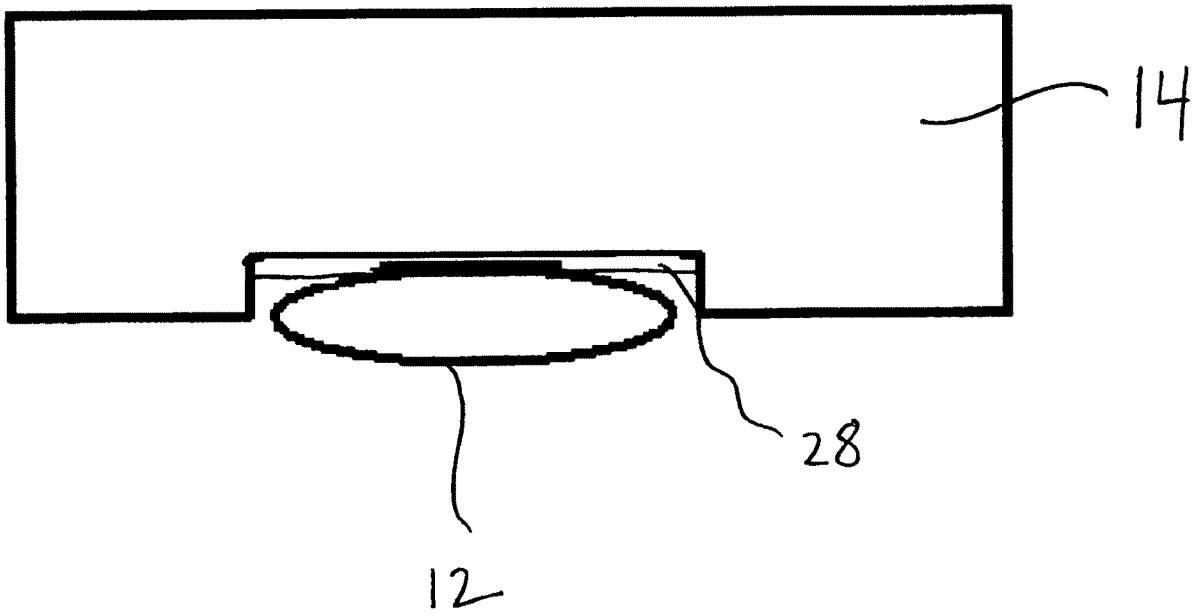
FIG. 4*b* is a cross sectional of one embodiment of the rigid band and barrier.
Figure 4C:
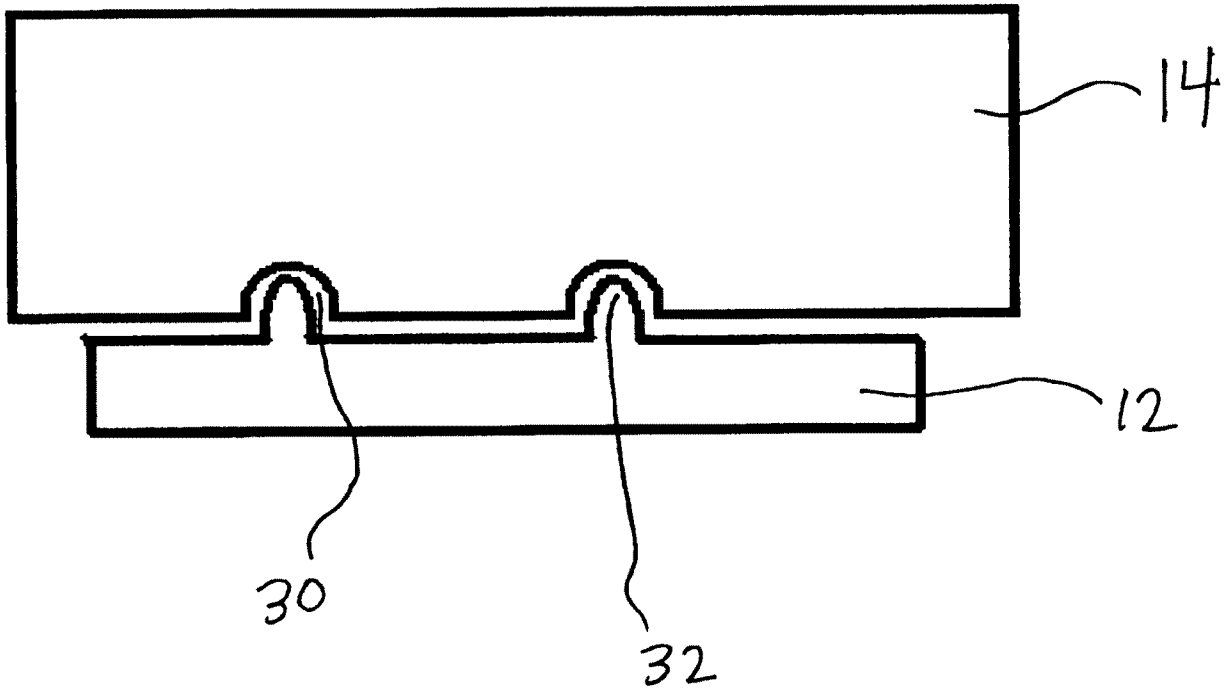
FIG. 4*c* is a cross sectional of one embodiment of the rigid band and barrier.

The rigid band 14 is removably connected to a portion of the barrier 12. The rigid band 14 may be connectable to the barrier 12 via friction between the rigid band 14 and the barrier 12, such as between an upper surface of the barrier 12 and an inner surface of the rigid band 14. The rigid band 14 may include an elastomeric strip 28, as shown in FIG. 4*b* on an inner surface thereof to engage the barrier 12 through friction contact. The rigid band 14 or barrier 12, or both, may include an adhesive for connecting to one another. As shown in FIG. 4*c*, one of the rigid band 14 and the barrier 12 may include detents 30 and other of the rigid band 14 and the barrier 12 may include projections 32 which match the detents 30 and engage the detents 30 to retain the rigid band 14 on the barrier 12. The rigid band 14 may include a groove along a center thereof in which the barrier 12 fits to retain the rigid band 14 and barrier 12 together.

A waterproof shield 34 is attached to the rigid band 14 and surrounds the restrained portion of the hair. The waterproof shield 34 includes a liquid impermeable sheet wherein a first portion of a perimeter of the liquid impermeable sheet is attached to the barrier to form a waterproof seal between the first portion of the perimeter of the liquid impermeable sheet and the barrier.

The liquid impermeable sheet is a flexible rectangular sheet which is gathered with an elastic edge. At least 80% of the perimeter of the liquid impermeable sheet is attached to the barrier and substantially the entire remainder of the perimeter is gathered by the elastic edge.

The rigid band 14 may include flexible ties or straps 40 attached to the ends thereof so that the user may tie the ties tightly under the chin or behind the lower back portion of the head. The straps may attached to the ends by one of a number of different fasteners, including a button and hole, a hole in the ends and an enlarged portion on the straps, gluing, injection molding, or any other equivalent method of fastening. The ends of the rigid band are wider than the remaining portion between those ends. This allows for easier attachment of the straps as well as better retaining of the rigid band on the head of the user.

Figure 5:
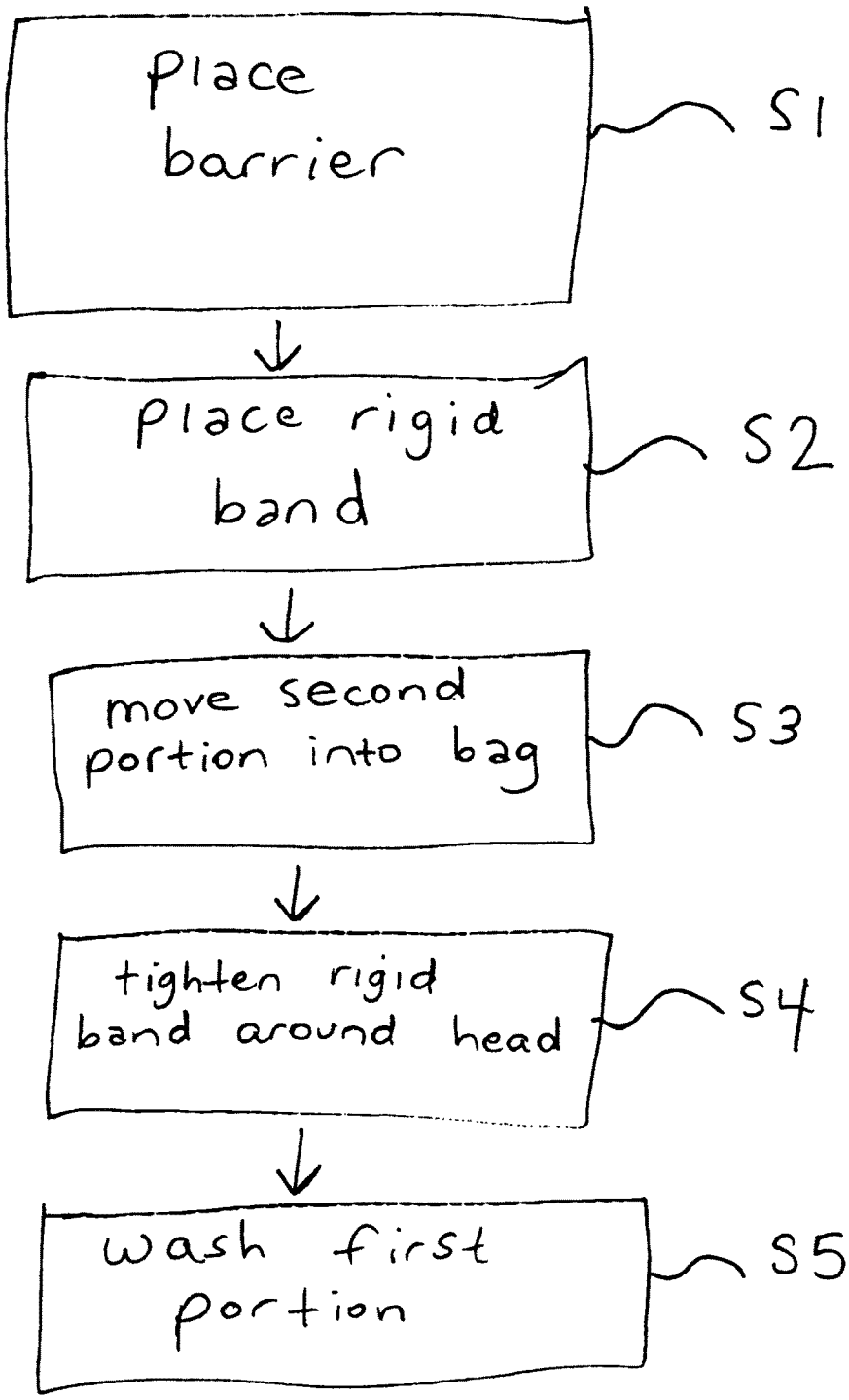
FIG. 5 is a flow chart of an exemplary embodiment of the method.

As shown in FIG. 5, a method of removing oil from a first portion of a user's hair includes placing an elastic band or barrier at a location on a head of the user which divides the first portion of the hair to be washed from a second portion of the hair to remain dry S1; and placing a rigid band comprising a liquid impermeable bag partially attached thereto over the elastic band S2; moving the second portion of the hair to remain dry to an inside of the liquid impermeable bag through a portion of the liquid impermeable bag which is detached from the rigid band S3. In step S1, as show in FIG. 11, the location on the head of the user is midway between: (a) a front of the head 200, or a line defining the front of the hair 212 adjacent the forehead, and (b) a rear or crown of the head 204. The band is U-shaped. The band is placed on the head such that the band extends along a vertical plane P extending through the ears 206 of a user, as show in FIG. 11.

In addition, the method includes tightening the liquid impermeable bag or the rigid band about the second portion to substantially encompass the second portion S4 after moving the second portion of hair to the inside of the bag and before washing the hair. In either of steps S1 or S4, a bottom of the rigid band or a bottom of the elastic band is placed along a hairline immediately behind the ears 206 of the user, to cover an entirety of the hair in the back of the head. Next, the method includes washing the hair S5, wherein the first portion of the hair is washed and the second portion of the hair remains dry. Lastly, the method includes removing the rigid band and attached bag from the user's head S6 after washing the hair, and then removing the elastic band from the user's head S7, and drying the first portion of the hair S8 after washing the second portion of hair.

Figure 6:
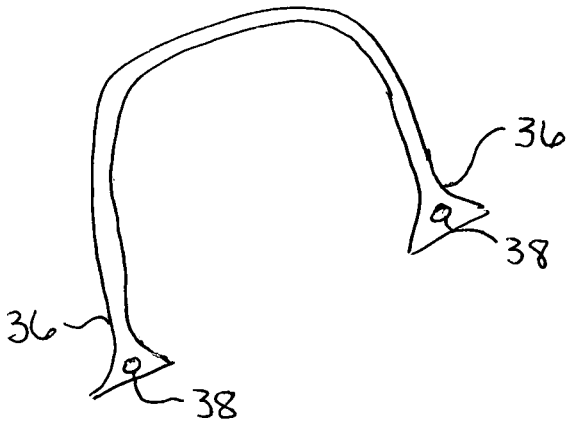
FIG. 6 is a perspective view of an alternative embodiment of the rigid band of FIG. 1.

FIG. 6 illustrates an alternative embodiment of the rigid band having widened distal ends 36, each with an associated fastener 38.

Figure 7:
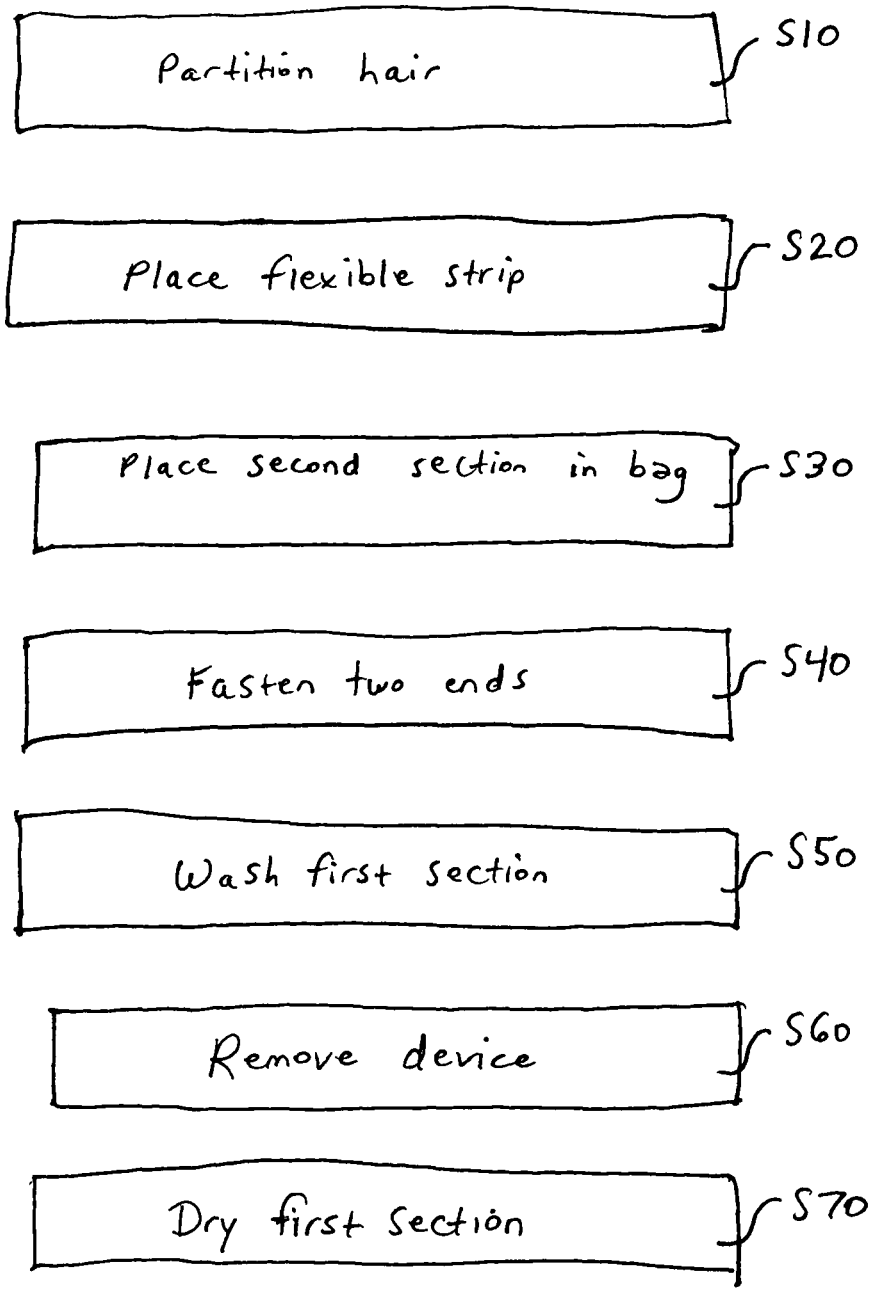
FIG. 7 is a flow chart of another exemplary embodiment of the method.

FIG. 7 illustrates an alternative embodiment which includes a method of removing oil from a first portion of hair of a user using a device comprising a liquid impermeable bag, an elastic band attached to one side of the bag, and a flexible strip attached to another side of the bag. The strip is pliable and movable into any desired shape or curve. The method includes partitioning the hair of the user into a first section and a second section defined by a boundary path on a head of the user which divides the first and the second sections S10. For example, the user may use a comb or other suitable sharp rigid edge to divide the hair from one ear to the other to form a first section from the forehead of the user to the boundary path and a second section from the boundary path to the rear neck of the user. The boundary path may be between the front hairline adjacent the forehead and the rear-most portion of the crown of the head.

The method also includes placing the flexible strip along the boundary path after partitioning the hair S20, attaching fasteners which are at the distal ends of the flexible strip to one another around the head of the user, placing the second section of the hair of the user inside the bag S30, and then attaching two distal ends of the elastic band to one another around the head of the user S40 and around the bag and flexible strip. Thereafter, the first section of the hair is washed while keeping the second section of the hair dry S50 due to the placing inside the liquid impermeable bag.

The placing of the flexible strip along the boundary path includes inserting claws which are disposed on the flexible path into the hair the user in order to secure placement of the flexible strip. The placing of the flexible strip may include placing the strip midway between the front and rear of the head.

The first section of the hair is located at a front portion of the head adjacent to a forehead of the user, and the second section of the hair is located at a rear portion of the head adjacent to a back of the user. The boundary line may be from the top of one ear to the top of the other ear of the user. The impermeable bag is aligned to a rear portion of the head while placing the flexible strip along the boundary path.

While attaching the two distal ends of the elastic band, the distal ends of the band are overlapped with a first portion of the impermeable bag immediately prior to or as the two ends are attached to one another. The flexible strip is disposed on a second portion of the impermeable bag different from the first portion of the impermeable bag. For example, the flexible strip is disposed on a top (second) half of the liquid impermeable bag. After the first section of the hair is washed, the first section is dried S70. This may be performed after removing the device S60 or prior to removing the device.

The flexible strip comprises a layer of a closed cell water resistant foam on an inner surface of the flexible strip. While washing the first section, water is blocked from passing between flexible strip and the hair by the layer of the closed cell water resistant foam.

Figure 8:
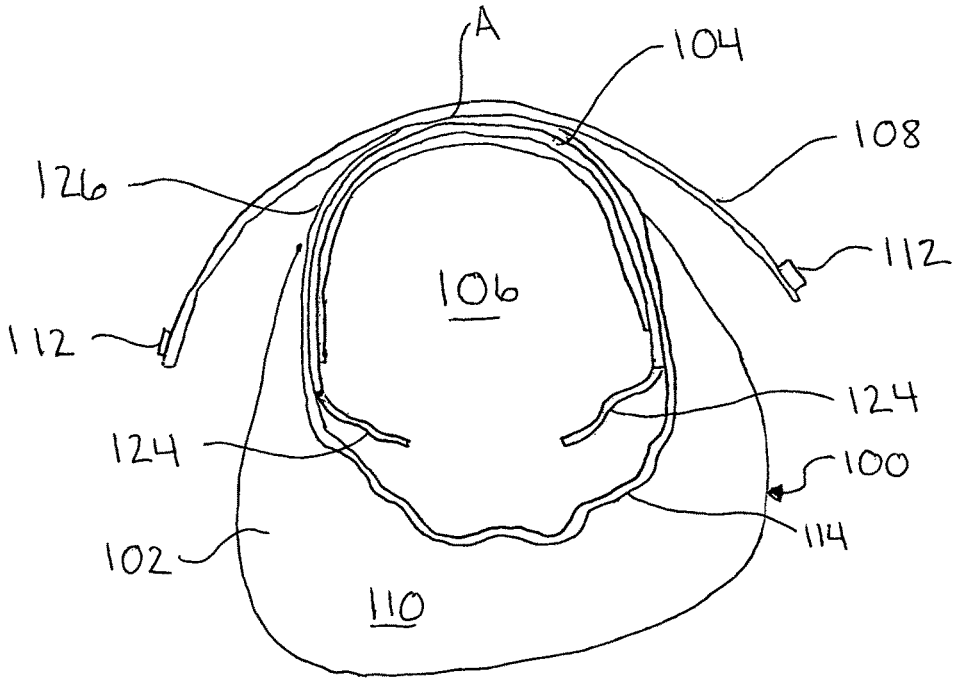
FIG. 8 is a front view of an alternative embodiment of the hair accessory.
Figure 9:
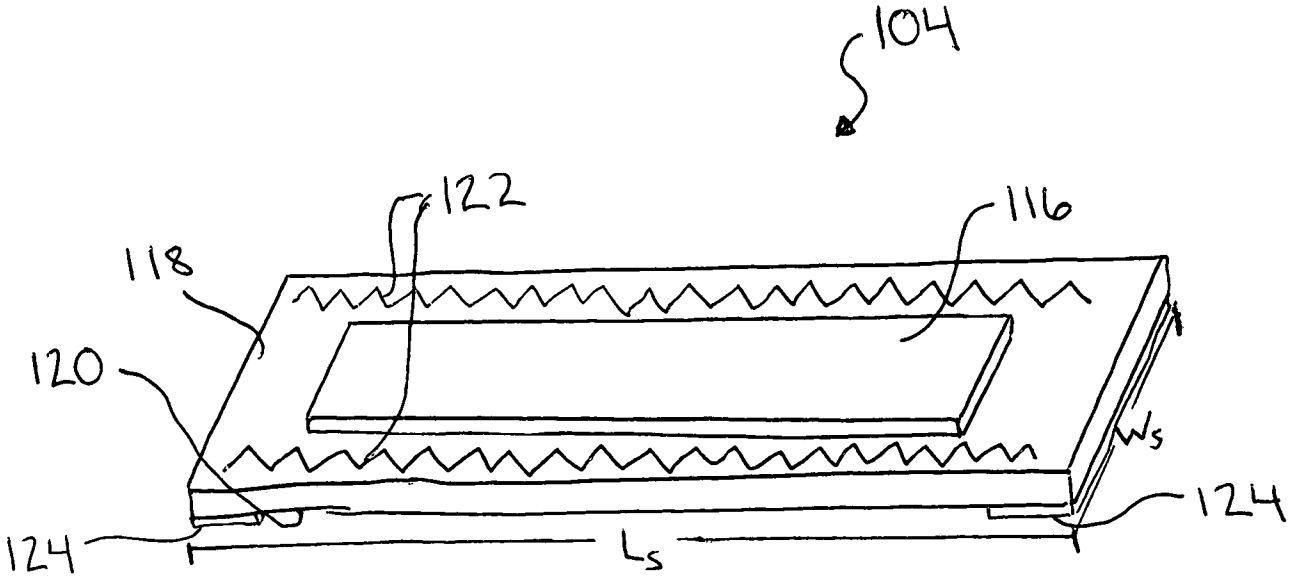
FIG. 9 is a perspective view of the flexible strip of the embodiment of FIG. 8 illustrating an alternative form of the fasteners.
Figure 10:
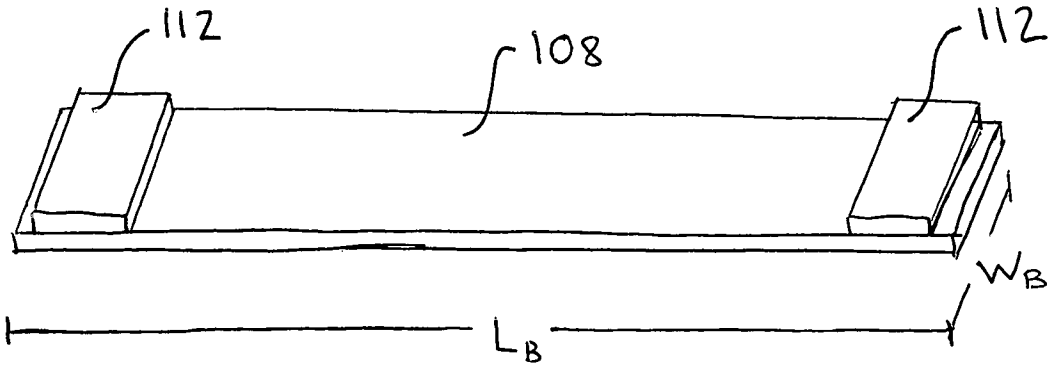
FIG. 10 is a perspective view of the elastic band of the embodiment of FIG. 8.

FIGS. 8-10 illustrate an alternative embodiment of the hair accessory which includes a liquid impermeable bag 100 comprising a flat sheet 102 gathered at one end, a flexible strip 104 attached to an inner surface 106 of the liquid impermeable bag, and an elastic band 108 attached to an outer surface 110 of the liquid impermeable bag. Fasteners 112 are disposed at two distal ends of the elastic band and are connectable to one another to fasten the elastic band around a head of a user overlapping a first (bottom) portion 114 of the impermeable bag. The two ends may each include one of the fasteners, such as a hook and loop fastener, a snap comprising male and female portions, a button and hole, or other like fastener.

The flexible strip 104 comprises a layer of closed cell water resistant foam 116 on an inner surface 118 of the flexible strip 104 and the flexible strip 104 is attached to the bag at an outer surface 120 of the flexible strip. In other words, on one side of the flexible strip is the bag and on the other side is the line of foam. The layer of closed cell system water resistant foam is formed in a complete line along the flexible strip in order to prevent water from penetrating into the impermeable bag by passing between the hair and the flexible strip. The flexible strip includes a plurality of claws 122 on the inner surface of the flexible strip. The claws form at least two rows along the length of the strip and the foam is disposed between two of the rows of the claws. The ends include fasteners 124. The fasteners may be hook and loop type fasteners, ties, snaps including male and female portions, or any other equivalent fastener, which may be connected to one another around the head of the user. The flexible strip 104 is attached to a second portion 126 of the liquid impermeable bag different from the first portion 114, wherein the second portion 126 is approximately half of the gathered one end of the flat sheet 102 of the liquid impermeable bag 100. The second portion 126 is the top half of the gathered end of the bag 100 whereas the first portion 114 over which the fasteners 112 fasten is the bottom half of the gathered end of the bag 100. The elastic band 108 is attached at a small area A at a center of the second portion. The small area is at the upper-most portion of the gathered end of the bag while on the user.

As can be seen in FIGS. 9 and 10, the flexible strip has a length $L_S$ and a width $W_S$ and the elastic band has a length $L_B$ and a width $W_B$. The length $L_B$ of the elastic band may be approximately two times the length of the flexible strip $L_S$. The width $W_B$ of the elastic band may be 2-3 times the width $W_S$ of the flexible strip.

These ratios are important in order for the device to properly block water from penetrating while simultaneously maintaining a correct position on the head of the user.

Figure 11:
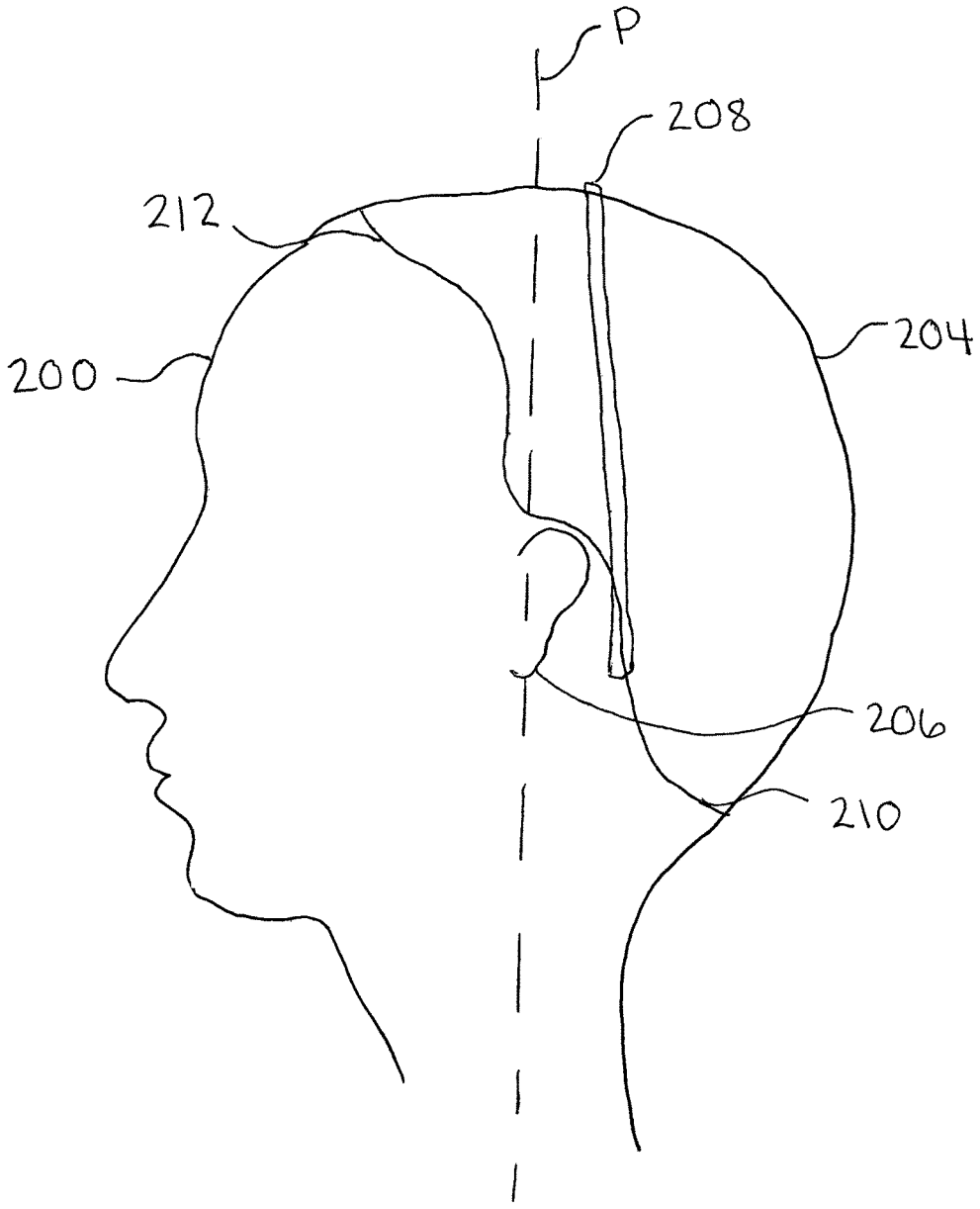
FIG. 11 is a side view of the location where the band is placed on the user.

As shown in FIG. 11, the band 208 which is first placed on the head of the user between the front 200 and rear 202 of the head, is placed substantially in a plane P that runs (vertically while the user is in a standing position) through the ears 206 of the user, or immediately rearward of this plane as shown. Substantially, means within a 15 degree angle of the plane P and/or within an inch from the plane P. The band 208 may be placed immediately behind the ears 206 of the user and along the hairline 210 adjacent the neck of the user. This location is particularly advantageous since placement of a bag or sock only over a ponytail, too rearward, leaves too much hair exposed to be wetted (as with PonyDry), and placing a bag at the forehead, too forward, does not reveal the roots of the hair to be cleaned (as with a shower cap). Preferably, the location is approximately midway between the front and rear of the head 200, 204. Preferably, the location is 2-3 inches rearward of the front hairline 212 of the user, adjacent the forehead, or front 200.

Other advantages and embodiments are within the scope of the appended claims as would be understood by one having ordinary skill in the art. The exemplary embodiments are merely exemplary and not intended as limiting the scope of the claims.

What is claimed is:

1. A method of removing oil from a first portion of a user's hair comprising:

placing an elastic band at a location on a head of the user which divides the first portion of the hair to be washed from a second portion of the hair to remain dry;

placing a rigid band comprising a liquid impermeable bag partially attached thereto over the elastic band;

moving the second portion of the hair to remain dry to an inside of the liquid impermeable bag through a portion of the liquid impermeable bag which is detached from the rigid band; and washing the hair, wherein the first portion of the hair is washed and the second portion of the hair remains dry, wherein the location on the head is approximately midway between a front of the head and a rear of the head.

2. The method of claim 1, further comprising drying the first portion of the hair.

3. The method of claim 2, further comprising tightening the liquid impermeable bag about the second portion to substantially encompass the second portion.

4. A method of removing oil from a first portion of a user's hair comprising:

placing a band comprising a liquid impermeable bag partially attached thereto at a location on a head of the user which divides the first portion of the hair to be washed from a second portion of the hair to remain dry;

moving the second portion of the hair to remain dry to an inside of the liquid impermeable bag through a portion of the liquid impermeable bag which is detached from the band; and washing the hair, wherein the first portion of the hair is washed and the second portion of the hair remains dry, wherein the location on the head includes immediately rearward of a user's ears.

5. The method of claim 4, wherein a layer of a closed cell water resistant foam is disposed on an inner surface of the band, and wherein the washing comprises blocking water from passing between the foam and the hair using the layer of the closed cell water resistant foam.

6. The method of claim 4, wherein the band is rigid and is U-shaped.

7. The method of claim 4, wherein the band is elastic.

8. The method of claim 4, further comprising, before the placing of the band, partitioning the hair of the user along a boundary path that divides the hair into the first and the second portions wherein the location is on the boundary path.

9. A method of removing oil from a first portion of hair of a user using a device comprising a liquid impermeable bag, an elastic band attached to one side of the bag, and a flexible strip attached to another side of the bag, the method comprising:

partitioning the hair of the user into a first section and a second section defined by a boundary path on a head of the user which divides the first and the second sections;

placing the flexible strip along the boundary path;

placing the second section of the hair of the user inside the bag;

attaching two distal ends of the elastic band to one another around the head of the user;

washing the first section of the hair while keeping the second section of the hair dry due to the placing inside the liquid impermeable bag, wherein the boundary path is midway between a front and a rear of the head.

10. The method of claim 9, further comprising attaching two distal ends of the flexible strip to one another after the placing of the flexible strip along the boundary path and before the placing of the second section of the hair inside the bag.

11. The method of claim 9, wherein the first section of the hair is located at a front portion of the head adjacent a forehead of the user, and the second section of the hair is located at a rear portion of the head adjacent a back of the user.

12. The method of claim 9, wherein the placing the flexible strip comprises aligning the impermeable bag to a rear portion of the head while placing the flexible strip along the boundary path.

13. The method of claim 9, wherein the attaching the two distal ends of the elastic band comprises overlapping the distal ends of the elastic band with a first portion of the impermeable bag while attaching the two distal ends of the elastic band to one another.

14. The method of claim 13, wherein the flexible strip is disposed on a second portion of the impermeable bag different from the first portion of the impermeable bag.

15. The method of claim 9, further comprising drying the first section of the hair prior to removing the device.

16. The method of claim 9, further comprising drying the first section of the hair after removing the device.

17. The method of claim 9, wherein the flexible strip comprises a layer of a closed cell water resistant foam on an inner surface of the flexible strip, and wherein the washing comprises blocking water from passing between flexible strip and the hair using the layer of the closed cell water resistant foam.

18. A method of removing oil from a first portion of a user's hair comprising:

placing a rigid band comprising a liquid impermeable bag partially attached thereto at a location on a head of the user which divides the first portion of the hair to be washed from a second portion of the hair to remain dry;

moving the second portion of the hair to remain dry to an inside of the liquid impermeable bag through a portion of the liquid impermeable bag which is detached from the rigid band; and washing the hair, wherein the first portion of the hair is washed and the second portion of the hair remains dry, wherein the location on the head is approximately midway between a front of the head and a rear of the head.

* * * * *